US007644857B2

(12) United States Patent
Chou

(10) Patent No.: US 7,644,857 B2
(45) Date of Patent: Jan. 12, 2010

(54) EXPANDABLE FILE FOLDER WITH SEPARATE CASES

(75) Inventor: Chih-Ying Chou, Jhonghe (TW)

(73) Assignee: James C. Huang, Taichung (TW)

( * ) Notice: Subject to any disclaimer, the term of this patent is extended or adjusted under 35 U.S.C. 154(b) by 693 days.

(21) Appl. No.: 11/356,683

(22) Filed: Feb. 21, 2006

(65) Prior Publication Data

US 2007/0194090 A1 Aug. 23, 2007

(51) Int. Cl.
*B65D 27/00* (2006.01)
*B65D 37/00* (2006.01)

(52) U.S. Cl. ..... 229/67.3; 229/67.4

(58) Field of Classification Search ..... 229/67.1–67.4; 383/26; 281/29, 31, 15.1, 21.1, 18, 43; 402/70, 402/73, 74

See application file for complete search history.

(56) References Cited

U.S. PATENT DOCUMENTS

| | | | | | |
|---|---|---|---|---|---|
| 554,574 | A | * | 2/1896 | Bennett | 206/425 |
| 621,732 | A | * | 3/1899 | Wyman | 190/16 |
| 1,699,971 | A | * | 1/1929 | Johnson | 190/109 |
| 1,842,077 | A | * | 1/1932 | Doughty | 206/425 |
| 1,980,683 | A | * | 11/1934 | Herrmann | 190/109 |
| 1,983,036 | A | * | 12/1934 | Kaufmann | 190/109 |
| 2,190,707 | A | * | 2/1940 | Feldman | 190/16 |
| 2,261,806 | A | * | 11/1941 | Hills | 312/9.43 |
| 3,954,128 | A | * | 5/1976 | Rushing et al. | 150/110 |
| D472,707 | S | * | 4/2003 | Ong | D3/290 |
| D487,191 | S | * | 3/2004 | Ong | D3/290 |
| 6,837,368 | B1 | * | 1/2005 | Chang | 206/232 |
| 6,880,747 | B1 | * | 4/2005 | Pelleg | 229/67.3 |
| 2005/0205449 | A1 | * | 9/2005 | Frankeny | 206/425 |
| 2006/0266807 | A1 | * | 11/2006 | Shook | 229/67.3 |
| 2007/0227926 | A1 | * | 10/2007 | Shapiro | 206/425 |

FOREIGN PATENT DOCUMENTS

| | | | |
|---|---|---|---|
| ES | 2 024 738 | * | 3/1992 |

* cited by examiner

*Primary Examiner*—Jes F Pascua
(74) *Attorney, Agent, or Firm*—Egbert Law Offices PLLC

(57) ABSTRACT

The present invention provides an expandable file folder with separate cases, which has a case placed in the middle of the folder, and which, as a result, has little steadiness and tends to fall down. The first and second cases between the front and rear sides of the expandable storing part are set such that the file holder can be more steady in a standing position. Two separated supporting areas form beneath the two cases. Thus the folder, when placed, will not tend to fall down.

7 Claims, 9 Drawing Sheets

EXPANDABLE FILE FOLDER WITH SEPARATE CASES

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to an expandable file folder and more particularly to one that provides an innovative structural space with its separate cases.

BACKGROUND OF THE INVENTION

File folders refer to the variety of stationeries used to hold or store files, so it is simply impossible to make a list of all the widely differing file folders available now in the market. The file folders mentioned here are of special expandable types, and the most conventional structure of these types is shown in FIG. 1. The file folder consists of the front side 11, the back side 12, the two lateral sides 13, one flap 14 and several dividing sheets 15. Consequently, the divided spaces 16 are formed by the sheets. Because of its continuous W-shaped cross-section design in its two lateral sides, it is capable of flex-like snake-belly extension and renders the divided spaces 16 formed by dividing sheets 15 changeable in accordance with the flex of the two lateral sides 13. Thus, the file folder 10 will change its shape and appearance as the amount of file content varies. The conventional expandable file folder will keep its good orderly shape if A4-sized files are placed inside the file folder 10, because the width of this type of file paper is almost the same as that of the divided spaces 16 and can expand the folder in an evenly manner. However, if inside the folder are put files or stationeries (small notebooks, pencil boxes, pens and the like) of much smaller sizes than the divided spaces but with a considerable thickness, the two lateral sides will be expanded unevenly and the folder will look very ugly.

Therefore, another kind of expandable file folder has been produced. As shown in FIG. 2, it differs from the conventional type in that an inflexible case 23 is inserted between the front and back sidewalls 21 22 of the file folder 20. The divided spaces near the front and back sidewalls 21 22 are expandable. The fixed space provided by the case 23 can be used to accommodate the files and stationeries other than A4-sized files, such as small notebooks, pencil boxes and pens. The problem of crushing will also be solved. However, the following problems still exist for this kind of file folder structure.

As shown in FIG. 3, the case of the above-described expandable file folder 20 is inserted between the front and back sidewalls 21 22 of the file folder 20. As the case is usually only 2~3 centimeters thick, it is very difficult for the case alone to support the whole file folder and make it stand steadily. Although the bottom area of the file folder 20 will be increased in accordance with the amount of files placed inside the front or back expandable sections 24, the increased area is always indefinite. Therefore, when the user places the folder on the desk or on the floor, it will tend to fall down for loss of balance. Moreover, when the folder falls down, the surfaces of the front and back sides will get dirty, and the user will have to spend more time cleaning the folder. In addition, if the user wants to look for, take out or put in a file stored in the expandable sections, he has to stick open the storing space with one hand and look for, take out or put in a file with the other hand. This is because the expandable sections 24 are capable of restoration; once let go of, it will be restored to its original flat and shrunk condition and make the above actions difficult. This is where its inconveniences lie for the user.

Thus, to overcome the aforementioned problems of the prior art, it would be advancement in the art to provide an improved structure that can significantly improve the efficacy.

To this end, the inventor has provided the present invention of practicability after deliberate design and evaluation based on years of experience in the production, development and design of related products.

BRIEF SUMMARY OF THE INVENTION

The improvements of the present invention are discussed in the following section.

The present invention sets the first and second cases 40 50 between the front and rear sides of the expandable storing part 30. The file holder A can, in contrast with the folders in FIGS. 2 and 3, be more steady in standing position because of the two separated supporting areas formed beneath the two cases 40 50. Thus the folder, when placed, will not tend to fall down. Besides, when the expandable storing part 30 of the file folder is being stretched and expanded, the file storing space 34 formed in the expandable storing part 30 can always have a definite form because the separation of the first and second cases 40 50 can hold each other at bay. When this stretched and expanded state is maintained, the user will no longer need to stick open the storing space with one hand when looking for, taking out or placing the needed files. This will prove a real convenience.

The new effects of the present invention are discussed in the following section.

The present invention has a side flap 43 design on the two cases 40 50. More convenience is guaranteed because taking out or putting in the files or stationeries in the first case 40 (or in the second case), only requires the user to open this side flap 43, saving the trouble of opening the top flap 60, which is time wasting for its long length. While the side flap 43 is short because it is used only to cover the opening 41 of the first case 40.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
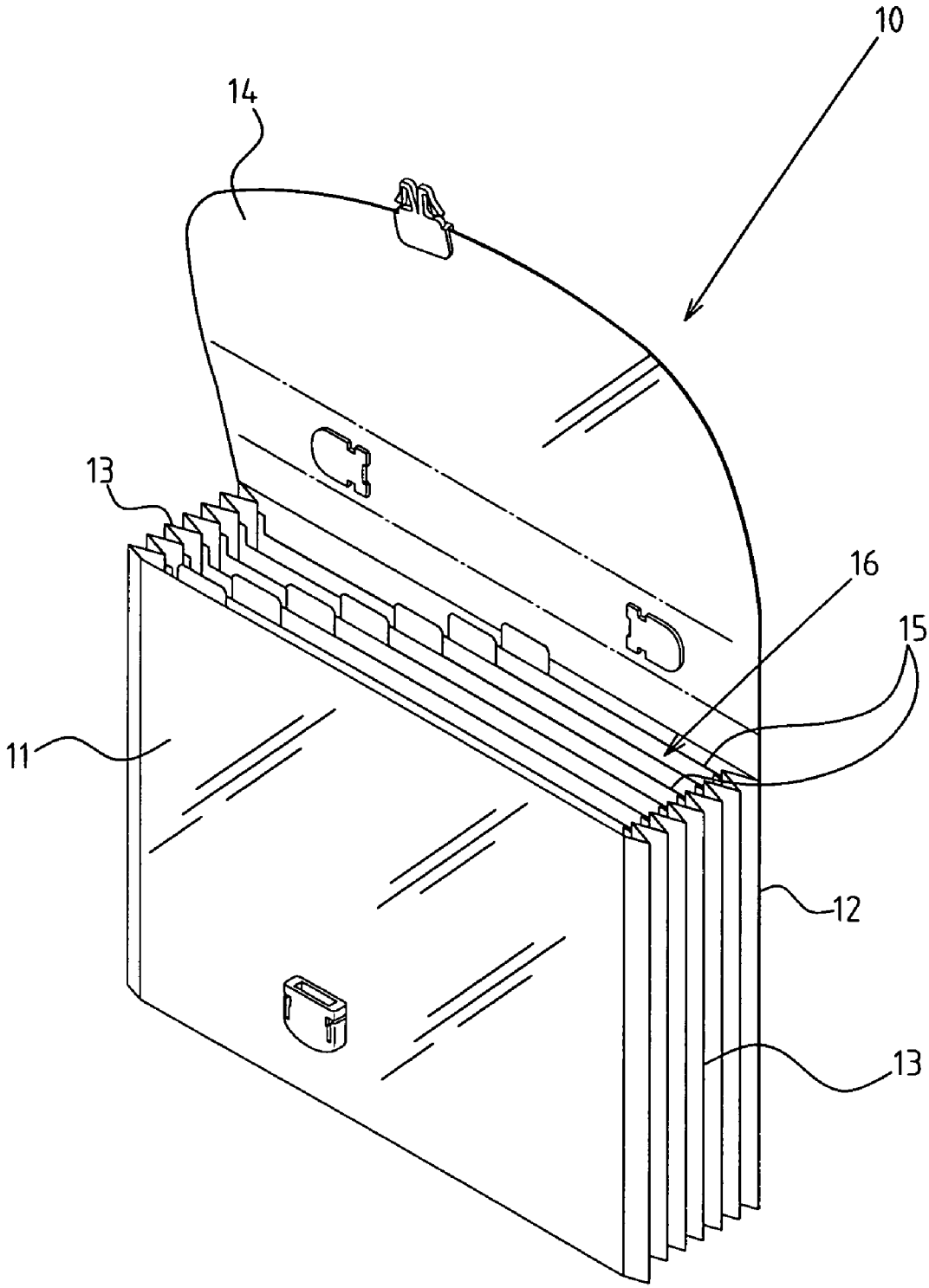
FIG.1 PRIOR ART
FIG. 1 shows a perspective view of the conventional file folder.
Figure 2:
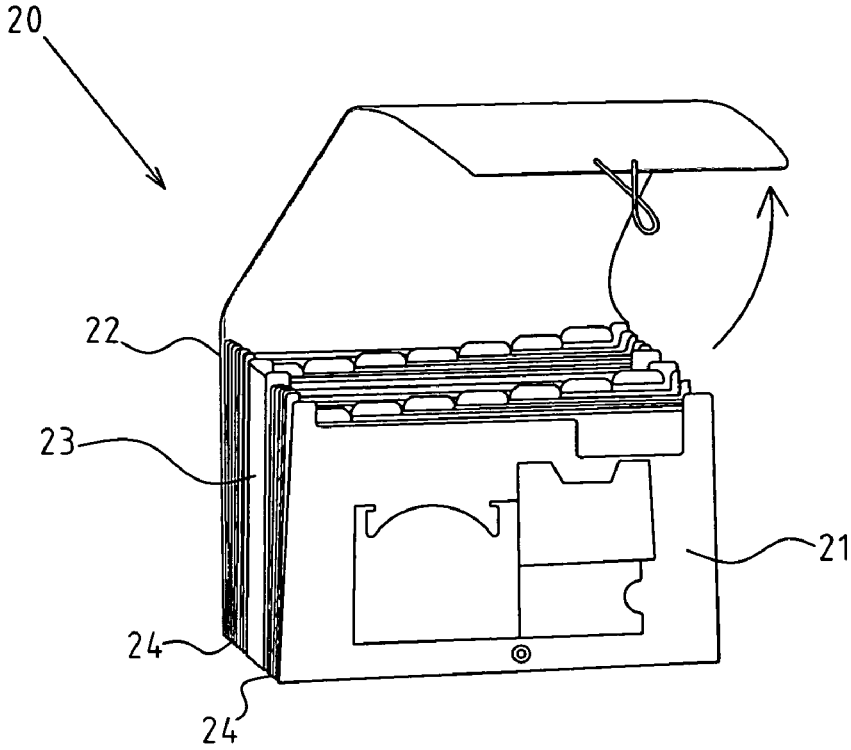
FIG.2 PRIOR ART
FIG. 2 shows a perspective view of another kind of conventional file folder.
Figure 3:
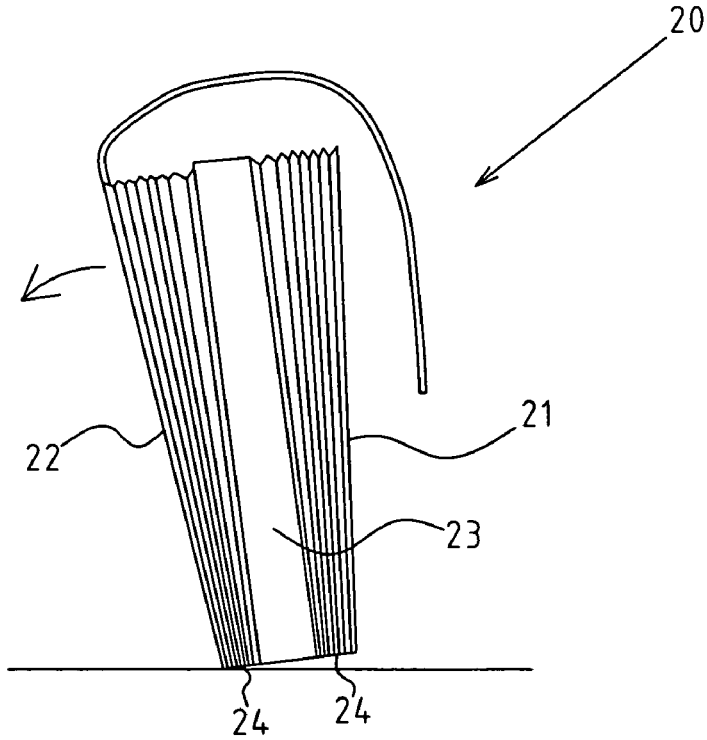
FIG.3 PRIOR ART
FIG. 3 shows a side elevation view of the file folder in FIG. 2 in its collapsed state.

As shown in FIGS. 4-7, there are preferred embodiments of the present invention. The embodiments herein provided are only for the purpose of illustration and so the patented expandable file folders will not be restricted to only what is shown in the embodiments.

A file folder A of the present invention includes an expandable storing part 30, which consists of right and left wrinkled walls 31, a bottom wall 32, several dividing sheets 33, and the file storing space 34 formed by the file storing space. The file storing space 34 can expand or shrink because of the flexibility of the right and left wrinkled walls 31.

A first case 40 is box-shaped and not flexible. It is in the front side of the expandable storing part 30 and has an opening 41 for the files and stationery to be put therein.

A second case 50 is box-shaped and not flexible. It is in the back side of the expandable storing part 30 and has an opening 51 for the files and stationery to be put therein.

A flap 60 is on the top of the expandable storing part 30. It is used to cover and close the file storing space 34. The flap 60 in this embodiment extends from the top of the second case 50 and at the end of the flap 60 there is a fastener 61, which can be fastened to the fastener base 42 at the outside of the first case 40. Thus, the flap 60 can be closed at a fixed position. At the top on both sides of the flap 60 can be made a handle 62, with which the whole folder A can be held.

Figure 6:
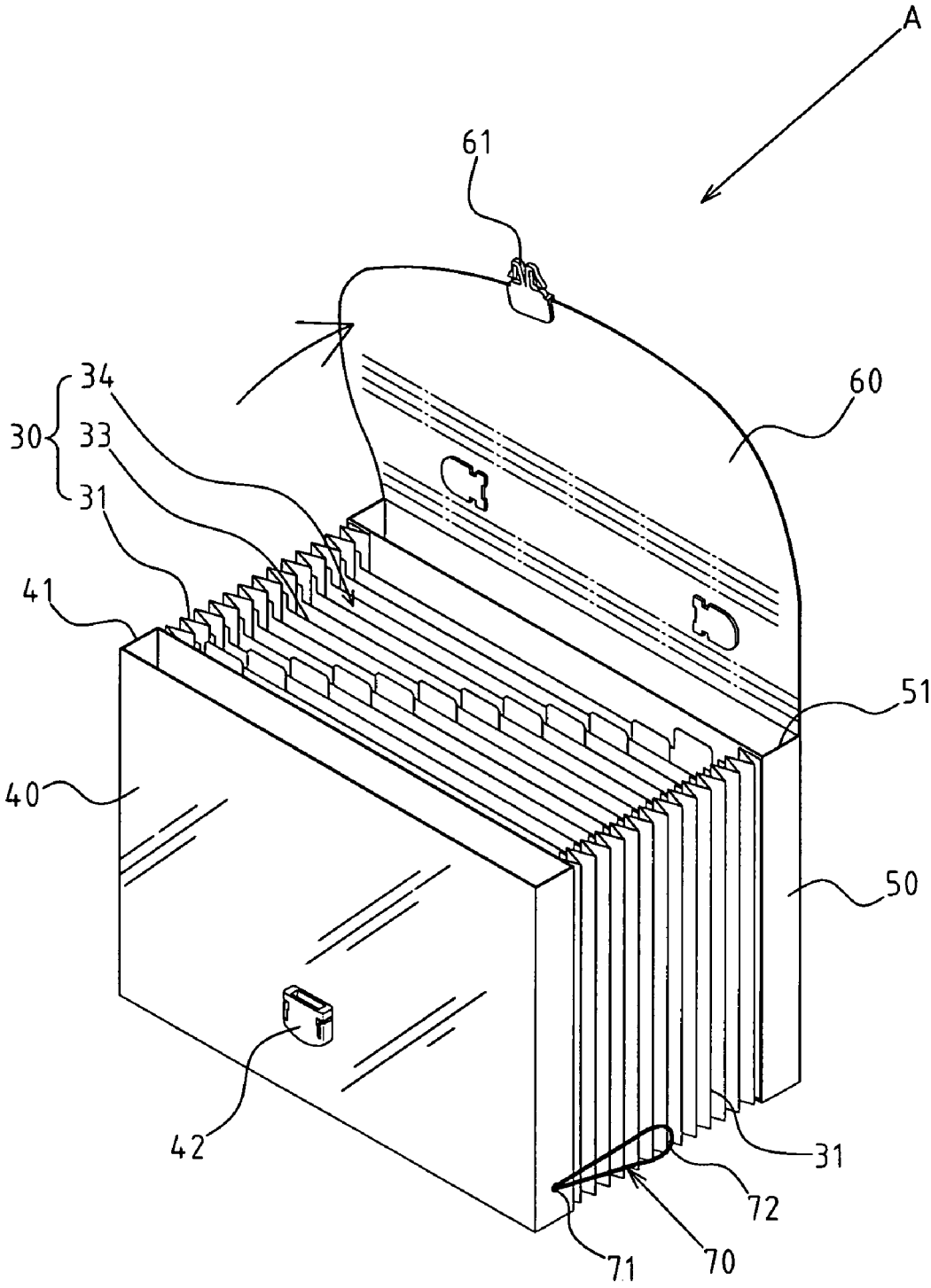
FIG. 6 shows a perspective view of the file folder in the opened form.

As shown in FIG. 6, the openings 41 51 of the first and second cases 40 50 can be set on the top, so the openings 41 51 of the first and second cases 40 50 and the openings of the file storing space 34 will all face upward. In this way, when the flap 60 is closed, the file storing space 34 and the first and second cases 40 50 can also be closed.

Figure 8:
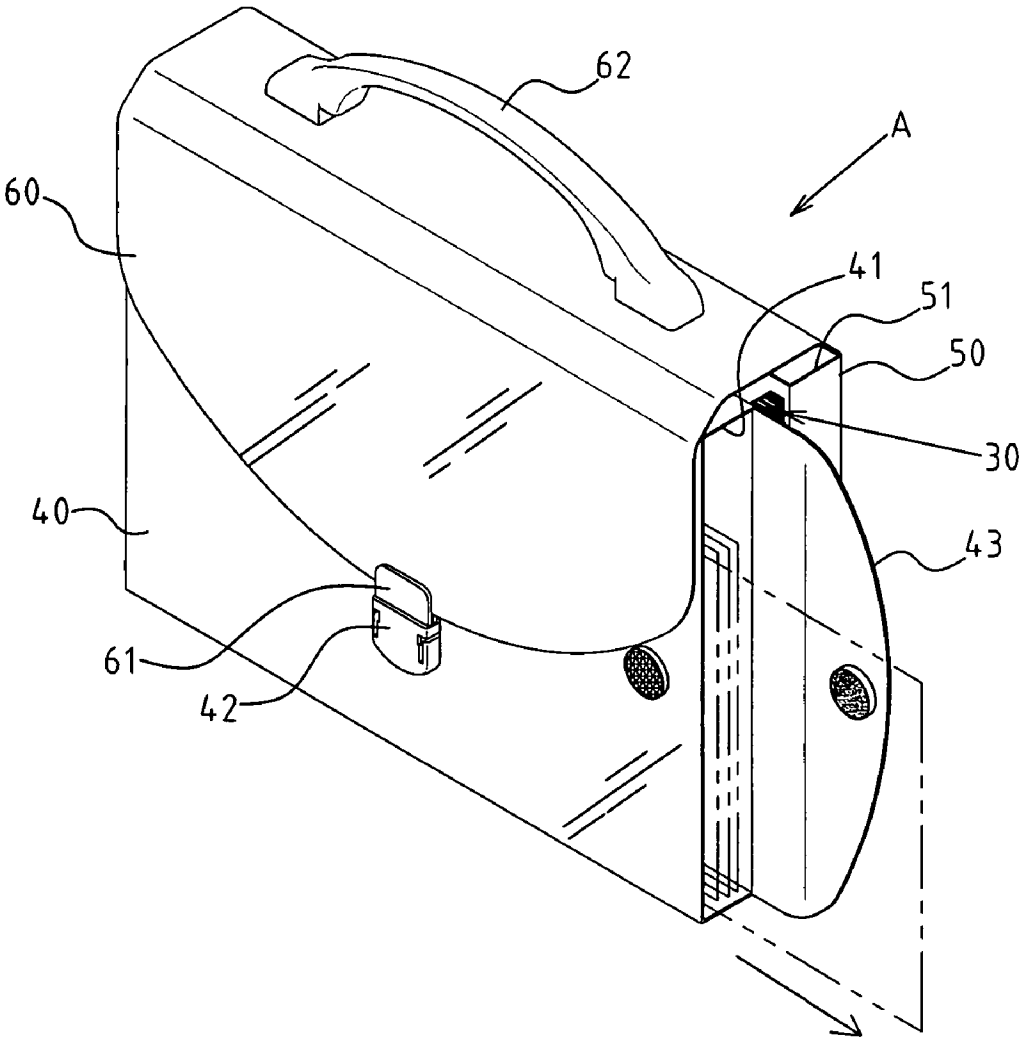
FIG. 8 shows a perspective view of the file folder with side flap on the cases.

As shown in FIG. 8, the opening 41of the first case 40 can also be placed on the side of the case and a side flap 43 can be made in the place to control the opening and closing of the opening 41. The side opening herein disclosed can be applied to either one or both of the two cases. With this side flap 43, more convenience is guaranteed because to take out or put in the files or stationery in the first case 40 (or in the second case), it is only just needed to open this side flap 43. The invention saves the trouble of opening the top flap 60, which is time wasting for its long length. The side flap 43 is short because it is used only to cover the opening 41 of the first case 40.

The elastic positioning cord 70 can be positioned between the first and second cases 40 50. It has a positioning end 71 and a connecting end 72. The positioning end 71 can be placed either in the first case 40 or in the second case 50 (in this embodiment it is placed in the first case). The connecting end 72 can connect to the matching connecting part 52 in the other case (in this embodiment it is placed in the second case). The elastic positioning cord 70 can be used to fix the distance between the first and second cases 40 50 and at the same time to restrict the expansion of the expandable storing part 30. The more specific embodiment of the elastic positioning cord 70 is shown in FIGS. 4 and 5.

Figure 9:
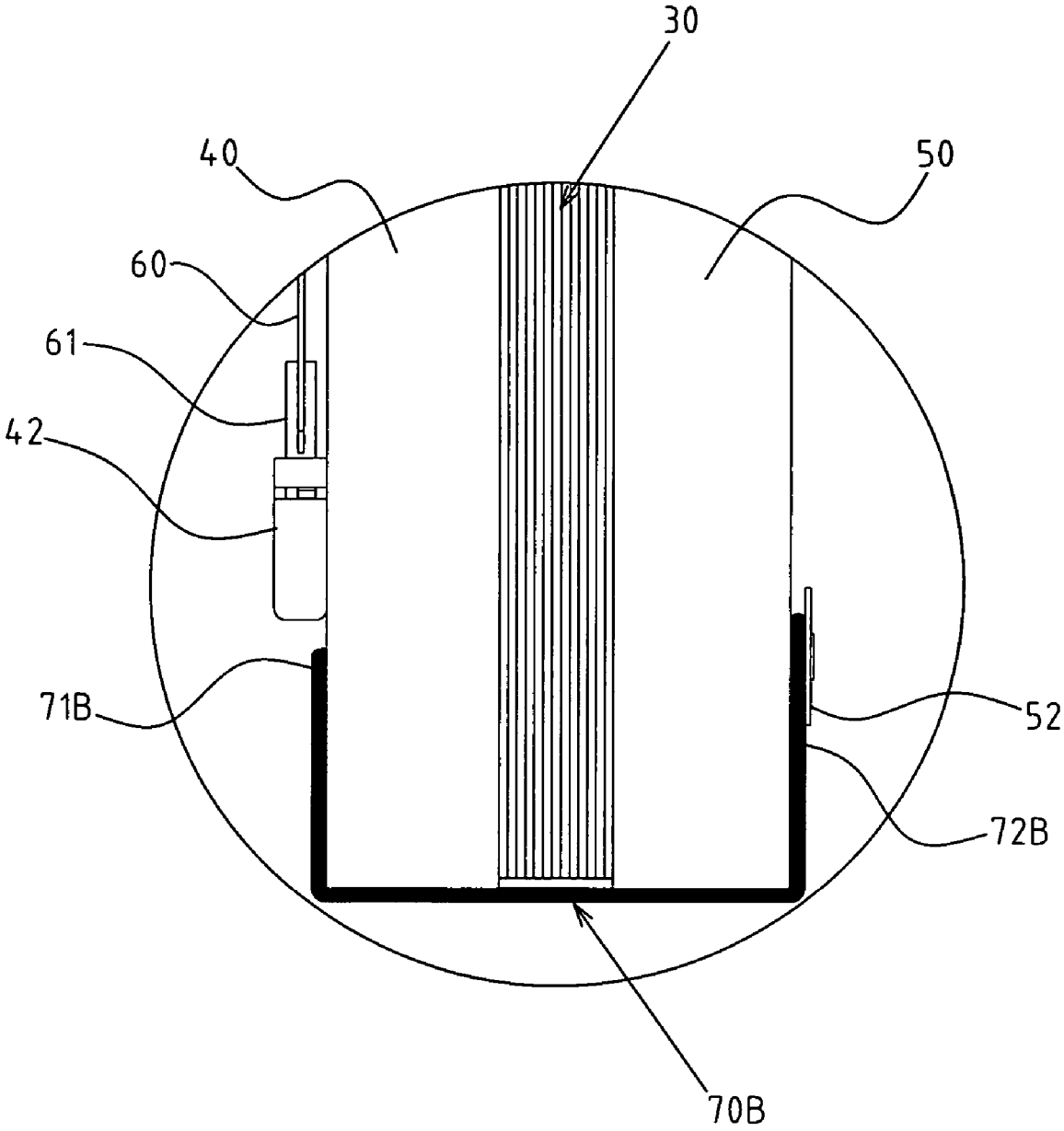
FIG. 9 shows a sectional view of the operation of the file folder in which elastic positioning cord is used.

The positioning end 71 of the elastic positioning cord 70 is designed at the side of the first case 40 so that its connecting end 72 can be linked, via the wrinkled walls 31 of the expandable storing part 30, to the connecting end 72 designed at the back side of the second case 50. Another embodiment of the elastic positioning cord 70B is shown in FIG. 9. Its positioning end 71B is placed at the front side of the first case 40 so that its connecting end 72B can be linked, via the bottom wall 32 of the expandable storing part 30, to the connecting part 52 designed at the back side of the second case 50.

Thus, the invention is based on the above structures. Herein the use of the present invention will be explained.

Figure 4:
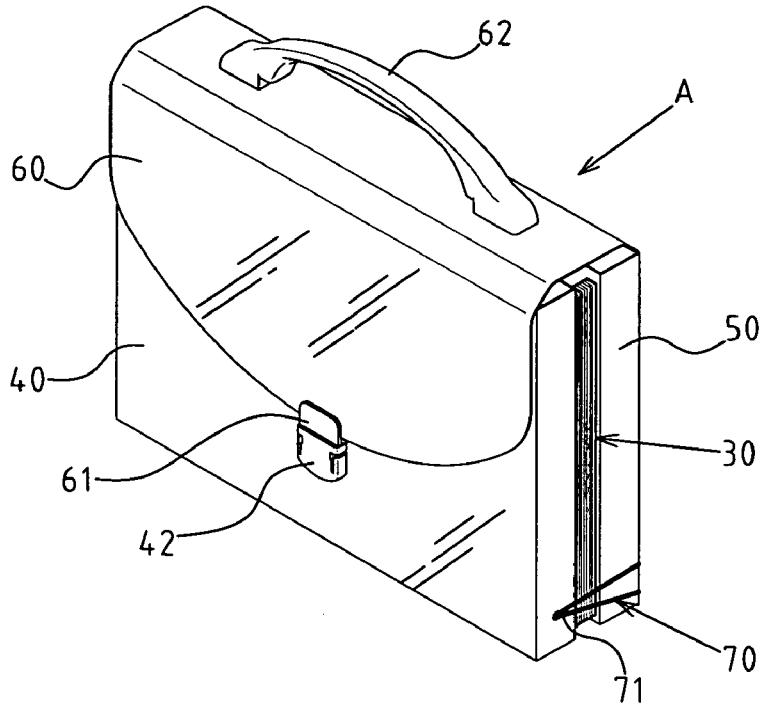
FIG. 4 shows a perspective view of the file folder in the closed form.
Figure 5:
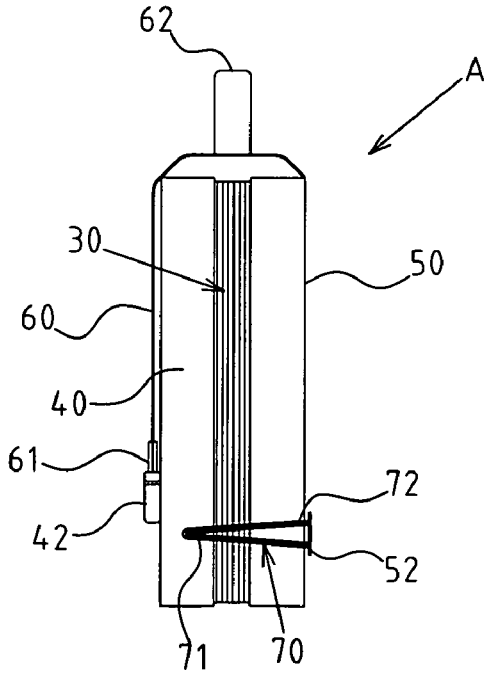
FIG. 5 shows a side elevation view of the file folder in the closed form.

As shown in FIGS. 4 and 5, the file folder A is closed with flap 60. When in this state, the openings of the first and second cases 40 50 and the openings of the file storing space 34 will be opened or closed by the flap 60. On the other hand, the elastic positioning cord 70 can be used to fix the distance between the first and second cases 40 50 and at the same time to restrict the expansion of the expandable storing part 30.

And when the file folder A is at its flattest state, it can stand very steady as a result of the increased firm contact area from the two separate cases: the first and second cases 40 50. Thus convenience is guaranteed for placing the folder.

Figure 7:
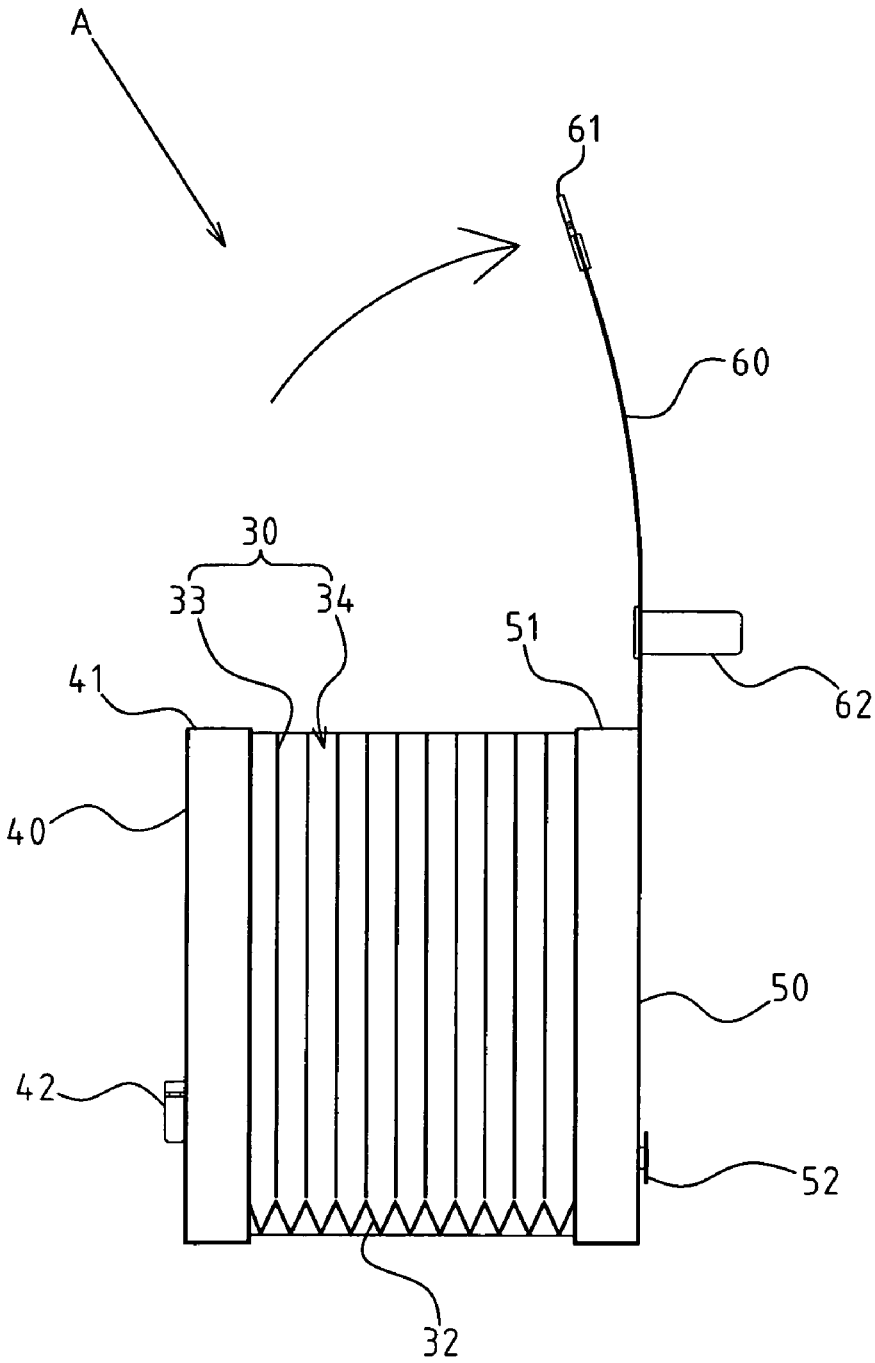
FIG. 7 shows a side elevation view of the file folder in the opened form.

The file folder's flap 60 in FIGS. 6 and 7 are opened. The elastic positioning cord 70 is in a loosened situation, and the expandable storing part 30 is in a stretched and expanded state. In this state the file storing space 34 formed in the expandable storing part 30 can always have a definite form because the separation of the first and second cases 40 50 can hold each other at bay. This is especially so when there are files placed in the first and second cases 40 50, because the increased weight will help to steady the file folder A even better. And the stretched and expanded state of the file storing space 34 will be kept, thus facilitating the fetching, searching and storing of files.

Figure 10:
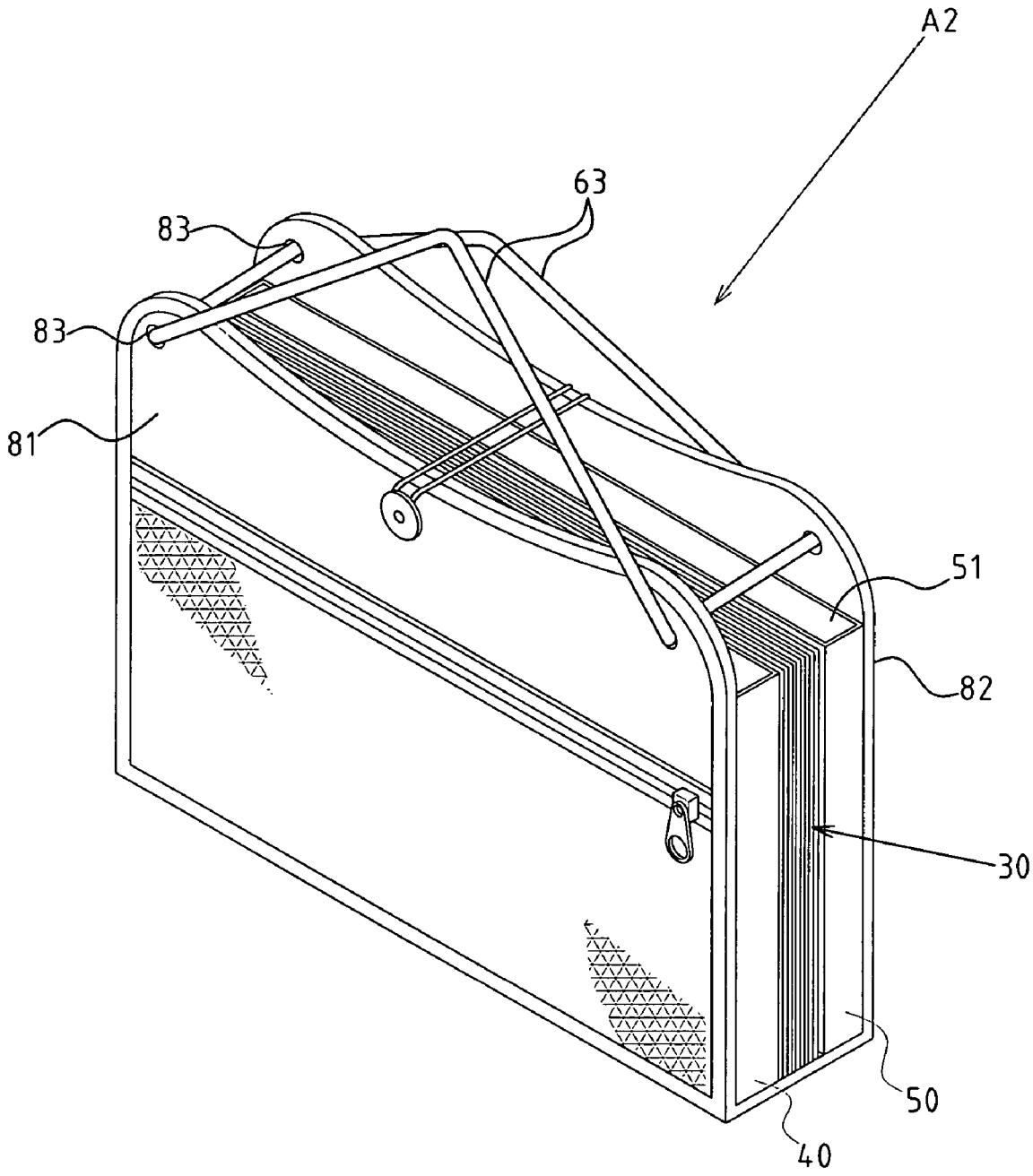
FIG. 10 shows a perspective view of the operation of the flapless file folder in the present invention.

The file folder A2 in FIG. 10 is flapless. This embodiment does not have a flap to which the handle 62 is originally attached. Instead, a cord 63 or a belt is used. The two ends of the cord 63 are respectively pulled through the cord holes 83 designed at the top of the front and rear walls 81 82 of the first and second cases 40 50. The holding part is thus formed as the two ends of the cord 63 are pulled upward. This arrangement will also help the top of the front and rear walls 81 82 move toward each other and the outward moving action will be prevented.

Figure 11:
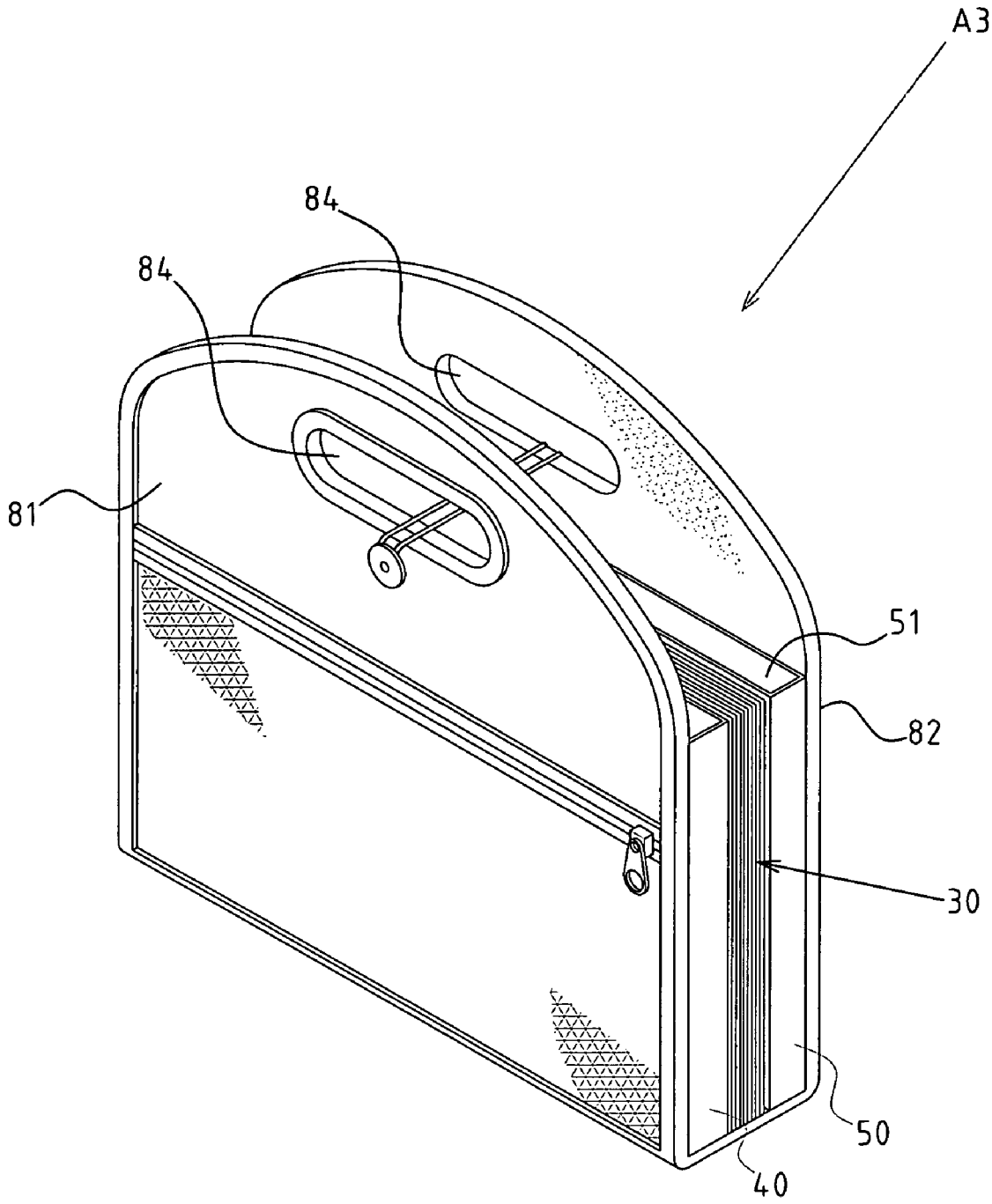
FIG. 11 shows another perspective view of the operation of the flapless file folder in the present invention.

The file folder A3 in FIG. 11 is another embodiment of flapless 60 holder. Its difference from the holder in FIG. 10 only lies in the handle hole 84 that is directly at the top of the front and rear walls 81 82 and thus helps to form the holding part.

I claim:

1. An expandable file folder apparatus comprising:

a rigid first case having a front wall and a back wall, said first case having side walls connected to said front wall and said back wall, said first case having a bottom wall extending between said front and back walls, said front wall and said back wall and said side walls and said bottom wall being of a non-foldable solid planar material;

a rigid second case having a front wall and a back wall with side walls connecting said front and back walls, said second case having a bottom wall extending between said front and back walls, said front wall and said back wall and said side walls and said bottom wall of said second case being of a non-foldable solid planar material;

an expandable storing section positioned between said back wall of said first case and said front wall of said second case, said storing section having wrinkled walls on opposite sides thereof, said storing section having a bottom wall at a bottom thereof, said storing section having several dividing sheets positioned above said bottom wall and between said wrinkled walls, said storing section being lengthenable relative to said distance between said first and second cases.

2. The expandable file folder apparatus of claim 1, each of said first and second cases having an opening at a top thereof.

3. The expandable file folder apparatus of claim 1, one of said side walls of said first and second cases comprising a side flap that is pivotable so as to define an opening of each of said first and second cases.

4. The expandable file folder apparatus of claim 1, further comprising:

an elastic positioning cord extendable between said first and second cases, said elastic positioning cord having a positioning end and a connecting end, said positioning end affixed to one of said first and second cases, said connecting end affixed to the other of said first and second cases.

5. The expandable file folder apparatus of claim 1, further comprising:

a flap extend over said expandable storing section so as to cover an open top thereof.

6. The expandable file folder apparatus of claim 1, further comprising:

a cord extending through a hole formed in said front wall of said first case and through a hole formed in said back wall of said second case, said cord defining a holding portion.

7. The expandable file folder apparatus of claim 1, said front wall of said first case having a first handle hole formed therein, said back wall of said second case having a second handle hole formed therein.

* * * * *